US010751892B2

(12) United States Patent
Godlieb et al.

(10) Patent No.: US 10,751,892 B2
(45) Date of Patent: Aug. 25, 2020

(54) GROOMING APPARATUS

(71) Applicant: KONINKLIJKE PHILIPS N.V., Eindhoven (NL)

(72) Inventors: Robert Godlieb, Eindhoven (NL); Jasper Zuidervaart, Eindhoven (NL); Roland Van Straaten, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 103 days.

(21) Appl. No.: 15/568,856

(22) PCT Filed: Apr. 19, 2016

(86) PCT No.: PCT/EP2016/058597
§ 371 (c)(1),
(2) Date: Oct. 24, 2017

(87) PCT Pub. No.: WO2016/173883
PCT Pub. Date: Nov. 3, 2016

(65) Prior Publication Data

US 2018/0111278 A1 Apr. 26, 2018

(30) Foreign Application Priority Data

Apr. 28, 2015 (EP) ..... 15165507

(51) Int. Cl.
*B26B 19/38* (2006.01)
*B26B 19/14* (2006.01)

(52) U.S. Cl.
CPC ..... *B26B 19/388* (2013.01); *B26B 19/14* (2013.01)

(58) Field of Classification Search
CPC ... B26B 19/388; B26B 19/14; B26B 19/3873; B26B 21/405; B26B 21/4056; B26B 21/4062; A45D 26/00
USPC ..... 30/45
See application file for complete search history.

(56) References Cited

U.S. PATENT DOCUMENTS

| | | | | |
|---|---|---|---|---|
| 1,647 A | 6/1840 | Morse | | |
| 6,189,215 B1 * | 2/2001 | Beerwerth | ..... | A45D 27/46 30/32 |
| 6,226,870 B1 * | 5/2001 | Barish | ..... | B26B 19/14 30/34.2 |

(Continued)

FOREIGN PATENT DOCUMENTS

| | | |
|---|---|---|
| CA | 2773801 A1 | 10/2012 |
| DE | 19606719 A1 | 8/1997 |

(Continued)

*Primary Examiner* — Phong H Nguyen

(57) ABSTRACT

A grooming appliance (100) comprising: a grooming mechanism (102) for grooming a user; a motor (104) arranged to operate the grooming mechanism; and a controller (106) configured to modulate a data signal into sound produced by the grooming appliance during the operation of the grooming mechanism by the motor, in order to transmit information relating to the grooming appliance. In embodiments, the sound being modulated is caused by the motor when operating the grooming mechanism. In this case the controller is arranged to supply a drive signal to the motor in order to control the motor, and to perform the modulation by varying the drive signal in order to modulate the data signal into the sound caused by the motor during operation of the grooming mechanism.

14 Claims, 6 Drawing Sheets

(56) References Cited

U.S. PATENT DOCUMENTS

| | | | | |
|---|---|---|---|---|
| 9,197,437 | B2 * | 11/2015 | Kim | H04L 43/50 |
| 2002/0092173 | A1 * | 7/2002 | Zuidervaart | B26B 19/14 30/34.2 |
| 2007/0032270 | A1 | 2/2007 | Orr | |
| 2014/0056172 | A1 | 2/2014 | Lee | |

FOREIGN PATENT DOCUMENTS

| | | | |
|---|---|---|---|
| DE | 20115819 | U1 | 5/2002 |
| EP | 2555474 | A2 | 2/2013 |
| EP | 2747313 | A1 | 6/2014 |
| JP | 2262885 | A | 10/1990 |
| WO | 9825736 | A1 | 6/1998 |
| WO | 2011018781 | A1 | 2/2011 |

* cited by examiner

GROOMING APPARATUS

This application is the U.S. National Phase application under 35 U.S.C. § 371 of International Application No. PCT/EP2016/058597, filed on Apr. 19, 2016, which claims the benefit of International Application No. 15165507.3 filed on April 28, 2015. These applications are hereby incorporated by reference herein.

FIELD OF THE INVENTION

The present disclosure relates to a grooming appliance such as a shaver, hair-clipper or epilator.

BACKGROUND OF THE INVENTION

Grooming appliances include for example hair-grooming appliances, such as electric shavers, hair-clippers and epilators, having an electric hair-grooming mechanism in the form of a shaving mechanism, hair-clipping mechanism or epilating mechanism, respectively, with the mechanism being operated by an electric motor. The rotor of the motor is mechanically coupled to the grooming mechanism (directly or indirectly), so that when the motor is energized, the rotor rotates and thus causes the grooming mechanism to move in the manner by which it performs its respective function (such as to shave, clip or epilate hair).

Traditionally grooming appliances had no means of outputting information to a user. Nowadays, there is a desire to allow the grooming device to interact with the user. However, typically grooming appliances still have a limited user interface display functionality and/or limited data processing functionality, if any. Therefore in some appliances, a feature may be added whereby the user interaction and/or the processing can be offloaded to a more powerful and/or better-equipped device in the form of an external user terminal, such as a smartphone, tablet or laptop computer. E.g. a shaver does not have the processor power that a data processing device such as a smartphone has, or a hair-clipper does not have the display and user interaction possibilities that a tablet or laptop computer has. Thus by connecting the grooming appliance to a user terminal such as a smart phone, tablet or laptop computer, the user interface display functionality and/or data processing capacity can be enhanced.

To enable the user terminal to provide such enhanced functionality requires some form of connection between the grooming appliance and the user terminal, in order to transmit data between the grooming appliance and the user terminal (at least in the direction from the grooming appliance to the user terminal). This may be implemented by either a cable connection or a wireless connection. Such a connection typically requires specific additional components to be included in the grooming device, such as a cable, a connector, an infrared transceiver, or a Wi-Fi-module or other such RF antenna and front-end.

Patent application publication document EP 2 555 474 A2 discloses a home appliance having a separate sound module for generating coded sound messages and a home appliance diagnostic system capable of deconding such sound messages.

SUMMARY OF THE INVENTION

It is recognized herein that these additional components are not necessarily desirable to add to a grooming device, e.g. in that they make the appliance more cumbersome (e.g. adding a wired connection), and/or in that they increase the cost and/or complexity of manufacture (e.g. adding an RF front-end and antenna), and/or in that they require extra space to be found in housing of the appliance (the footprint). It would be desirable to enable communication from the appliance to a user terminal without adding such extra components, or at least reducing the encumbrance, complexity and/or footprint of the extra components.

According to one aspect disclosed herein, there is provided a grooming appliance comprising: a grooming mechanism for grooming a user; a motor arranged to operate the grooming mechanism; and a controller configured to modulate a data signal into sound produced by the grooming appliance during the operation of the grooming mechanism by the motor, in order to transmit information relating to the grooming appliance.

For instance, the grooming appliance may take the form of a shaver, hair-clipper or epilator; the grooming mechanism being a shaving mechanism, hair-clipping mechanism or epilating mechanism respectively. In embodiments, the grooming appliance may be a hand-held grooming appliance.

Preferably, said sound is a sound caused by the motor when performing said operation of the grooming mechanism. In this case, the controller is arranged to supply a drive signal to the motor in order to control the motor to perform said operation of the grooming mechanism, and is configured to perform said modulation by varying the drive signal in order to modulate said data signal into the sound caused by the motor during said operation of the grooming mechanism.

Thus it is possible to create an acoustic channel for transmitting data from the grooming appliance to a data processing device having a microphone. For example, this can allow an application running on the data processing device to use the modulated sound to generate a user display for output to the user through a user interface of that device. The grooming appliance can then be used in conjunction with the data processing device, e.g. a user terminal such as a smartphone, tablet or laptop, in order to provide enhanced functionality (e.g. diagnostics). Further, by modulating the sound generated by the grooming device motor and/or associated mechanism to transmit the data from the grooming to the data processing device, this can be achieved without the need to add an additional communication front-end (e.g. RF front-end, wired connector or cable, etc.), and without even adding any additional sound generating components.

In one embodiment the signal is created by switching the motor on and off at a pre-arranged pattern in order to convey meaning. In this case the controller is configured to perform said variation of the drive signal by switching the drive signal between an on state which controls the motor to turn on and an off state which controls the motor to turn off.

Alternatively in a more advanced embodiment, the grooming device is equipped with a motor control circuit such as an H-bridge that enables a forced deceleration of the motor, either to brake the motor or even reverse its direction. In this case, the controller may be configured to perform said variation of the drive signal by switching the drive signal between a forward state which controls the motor to rotate in a forward direction and a reverse state which controls the motor to rotate in a reverse direction, or the controller may be configured to perform said variation of the drive signal by switching the drive signal between an on state which controls the motor to turn on and brake state which controls the motor to brake.

The disclosed techniques of modulating the sound of the motor and/or mechanism may be used to transmit various types of information relating to the grooming appliance. E.g. this information may comprise one or more of: information on a status of the grooming appliance, a unique identification of the grooming appliance, an identification of a model and/or type of the grooming appliance, an identifier of a user of the grooming appliance, an indication of one or more capabilities of the grooming appliance, an indication of one or more instructions for using the grooming appliance, and/or authentication information for authenticating the grooming appliance to communicate via another communication channel.

For instance, the transmitted information may comprise at least information on the status of the grooming appliance, which may comprises one or more of: a battery level of a battery powering said motor; an indication of a fault with the grooming device; an indication that a consumable of the grooming appliance is in need of replacement or approaching the need for replacement; an indication that the grooming mechanism is in need of cleaning, service or repair or approaching the need for cleaning, service or repair; and/or an indication that the grooming appliance is locked such that said grooming mechanism cannot be operated (this latter example would require a brief, temporary on period despite being locked, which may be acceptable as this does not necessarily drain the battery too much).

According to another aspect disclosed herein, there is provided a computer program product comprising code embodied on a computer-readable storage medium and configured so as when run on a user terminal to perform operations of: using a microphone of the user terminal to receive the sound of a grooming appliance during operation of the grooming appliance, the sound comprising motor sound and grooming mechanism sound, thereby generating an audio signal representative of said sound; processing the audio signal to detect a data signal modulated into said motor sound and/or grooming mechanism sound, the data signal comprising information relating to the grooming appliance; and outputting the information detected from said processing of the audio signal, or content mapped to said information, to a user as part of an application relating to the grooming appliance.

In embodiments, said processing may be performed by analysing a time-varying amplitude of a waveform of the audio signal. Alternatively, said processing may be performed by analysing a time-varying spectrum of the audio signal.

In embodiments, said information may comprise one or more of: a unique identification of the grooming appliance, an identification of a model of the grooming appliance, an identification of a type of the grooming appliance, an identification of a user of the grooming appliance, and/or a status code indicating a status of the grooming appliance; and said outputting may comprise looking up content mapped to the identification and/or status code, and outputting said content to the user as part of said application.

In one particularly advantageous use case, said application may take the form of a smart mirror application, which uses a camera of the user terminal (e.g. a front-facing camera) to capture an image of the user and display the image to the user via a screen of the user terminal. In this case, said outputting of said information comprises augmenting the displayed image of the user based on said information.

According to another aspect disclosed herein, there is provided a user terminal comprising: a microphone for receiving the sound of a grooming appliance during operation of the grooming appliance, and thereby generating an audio signal representative of said sound; a user interface; and a signal processing module configured to processing the audio signal to detect a data signal modulated into said sound, the data signal comprising information relating to the grooming appliance; wherein the signal processing module is arranged to output the information detected from said processing of the audio signal, or content mapped to said information, to a user via said user interface.

In embodiments, the user terminal may take the form of a mobile user terminal such as a smartphone, tablet or laptop computer. Alternatively the user terminal may be a stationary type of terminal such as a desktop computer, or even a dedicated grooming terminal being a fixture, fitting or furnishing of a room such as bathroom or bedroom.

BRIEF DESCRIPTION OF THE DRAWINGS

To assist understanding of the present disclosure and to show how embodiments may be put into effect, reference is made by way of example to the accompanying drawing in which.

DETAILED DESCRIPTION OF THE EMBODIMENTS

Many personal data-processing devices such as smartphones, tablets, and laptop computers are capable of running software to provide an additional function to accompany the use of a grooming appliance, such as to guide the user towards purchasing consumable parts, and/or to provide diagnostics (e.g. your battery is at 56%, and requires 32 minutes charging until full). As another example, e.g. for a grooming device such as a shaver or epilator, an application running on a data-processing device may also provide the user with guidance as an integral part of the usage of a grooming appliance. For instance, an application could use the front-facing camera of a user terminal to provide visual user feedback (a 'smart mirror').

To be able to provide such enhanced functionality, it is required that at least the data-processing device (the user terminal) can receive data from the grooming appliance.

Nearly all personal user terminals such as smartphones, tablets and laptops are nowadays equipped with a microphone. Furthermore, a common feature of electric shavers and other grooming appliances is that they are motor-driven. This motor causes the device to make acoustic noise when on (when the rotor is rotating), the sound emanating from the motor itself and/or from the vibration of one or more components of the grooming mechanism when operated by the motor. Also, an increasing number of these appliances contain not just a simple manual switch, but a controller such as a microcontroller with embedded software arranged to control the appliance's motor.

The following discloses examples of a system for modulating the drive voltage (and/or current) supplied to a grooming appliance's motor in order to generate a modulated sound. The appliance-enhancing software on the accompanying user terminal monitors the input of the terminal's microphone and extracts the encoded data communicated through this modulated sound.

Figure 1:
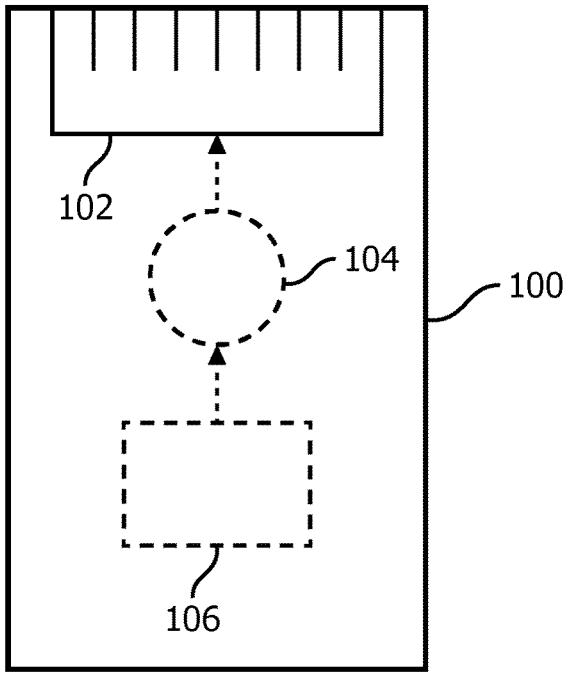
FIG. 1 is a schematic block diagram of a grooming appliance.

FIG. 1 is a diagram showing a grooming appliance 100 in accordance with embodiments of the present disclosure, preferably a hand-held grooming appliance. The grooming appliance 100 may for example be a shaver, hair clipper (hair trimmer) or epilator. The grooming appliance 100 comprises a grooming mechanism 102, e.g. a shaving, hair-trimming or epilating mechanism as appropriate to the type of appliance. The grooming appliance 100 also comprises an electric motor 104 having a rotor which rotates when the motor is energized by a drive signal. The rotor of the motor 104 is mechanically coupled to the grooming mechanism, e.g. by a drivetrain of the grooming mechanism 102, such that when the rotor rotates, it causes the grooming mechanism 102 to move cyclically in the manner it is designed to in order to perform its grooming function (e.g. shaving, clipping or epilating). Please note where it is said below that the motor rotates, this will of course be understood to be a short-hand meaning that the rotor of the motor rotates, in turn operating the grooming mechanism 102 to move in the cyclical fashion for which it is designed.

Figure 4:
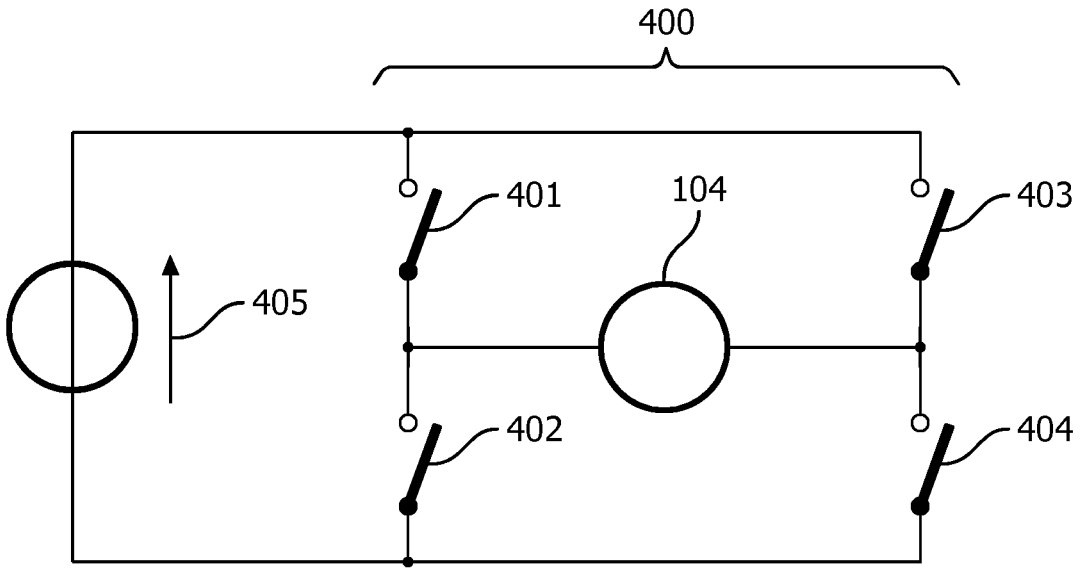
FIG. 4 is a schematic diagram of a circuit for driving a motor.

The grooming appliance 100 further comprises a controller 106 arranged to supply a drive signal to the motor 104 in order to selectively energize the motor 104. The controller 106 comprises power-supply circuitry (e.g. an H-bridge 400 as shown in FIG. 4) for supplying the drive signal to the motor 104 based on a power supply 405 (e.g. battery) of the grooming appliance 100 (power supply not shown in the figures). In addition, the controller 106 comprises associated control logic for controlling the state of the drive signal, and thereby controlling the drive signal to take different states at different times.

The control logic of the controller 106 may take the form of software stored on an embedded memory (comprising one or more memory devices) of the grooming appliance 100 and arranged to run on an embedded processor (comprising one or more processing units) of the grooming appliance 100. Alternatively the control logic of the controller 106 may be implemented in the form of dedicated hardware circuitry, or configurable or reconfigurable hardware circuitry such as a Programmable Gate Array (PGA) or Field Programmable Gate Array (FPGA), or any combination of such hardware and software included in the grooming appliance. Also, while it is preferred that the controller 106 is embedded in the grooming appliance 100, i.e. incorporated in the same housing, it is not excluded that some or all of the power supply circuitry and/or control logic of the controller 106 could be implemented externally to the housing of the grooming appliance 100.

By whatever means the controller 106 is implemented, in accordance with embodiments of the present disclosure, the controller 106 is configured to modulate the drive signal by varying its state in a time-varying pattern, and thereby modulate the sound produced by the motor and/or grooming mechanism when in operation, so as to encode data into this sound. This enables a user terminal within audible range of the sound to receive and decode the data, and thereby provide additional functionality to accompany the main grooming function of the grooming appliance 100. This will be discussed in more detail shortly.

Figure 2:
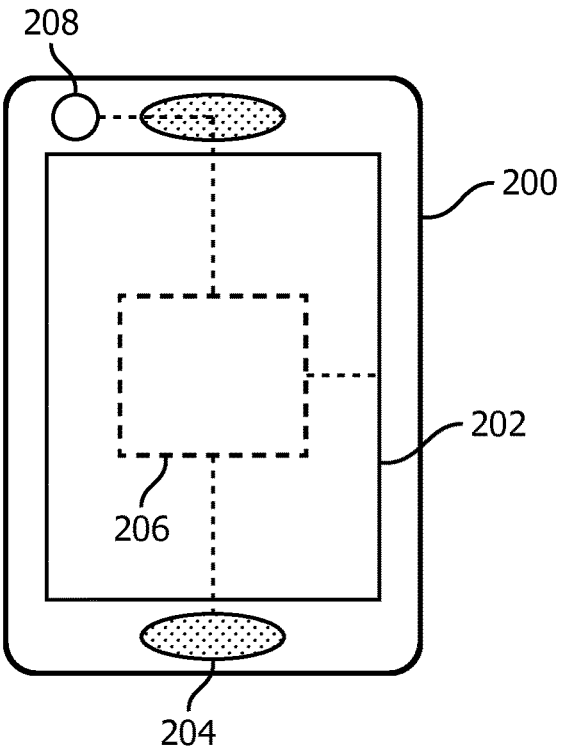
FIG. 2 is a schematic block diagram of a user terminal.
Figure 3:
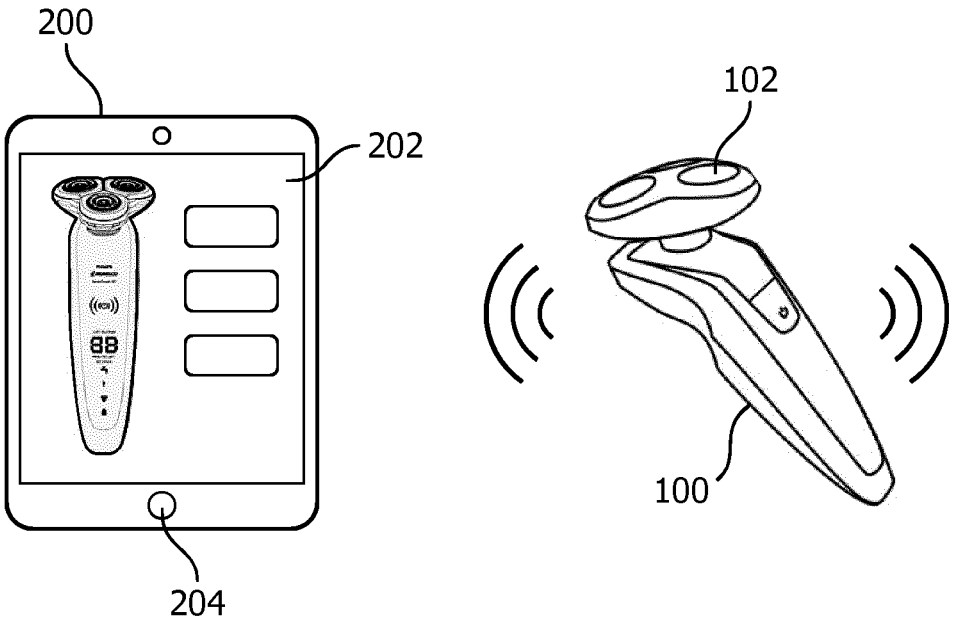
FIG. 3 is a schematic illustration of a system comprising a grooming appliance and user terminal.

FIG. 2 shows an example of a user terminal 200 in accordance with embodiments of the present disclosure, and FIG. 3 shows the grooming appliance 100 giving off sound to be detected by the user terminal 200. As mentioned, the user terminal 100 make take any suitable form, e.g. a mobile user terminal such as a smartphone, tablet or laptop; or a stationary user terminal such as a desktop computer or a dedicated grooming station incorporated as a fixture, fitting or furnishing of a room such as a bathroom or bedroom.

Whatever form it takes, the user terminal 200 comprises a user interface 202, at least one microphone 204, a signal processing module 206, and optionally a camera 208.

The user interface 204 comprises at least a user output means for outputting information to a user, e.g. a screen and/or speaker. Typically the user interface 204 will also comprise a user input means by which the user can interact with content output via the user interface (e.g. on the screen). E.g. the user input means may take the form of a touchscreen mechanism incorporated with the screen; and/or a separate pointing device such as a mouse, track pad or tracker ball combined with a point-and-click mechanism implemented through the screen; and/or a separate keypad, keyboard, joystick, gesture-based controller, etc. Any one or more of these user input and/or output means may be incorporated in the housing of the user terminal 200, or may be an external peripheral. The user interface 202 may comprise any one or any combination of these user input and/or output means and/or others, as long as it comprises at least one output user means (preferably at least a screen).

The microphone 204 may be the same microphone used for one or more other purposes, such as making phone calls and/or recording audio clips, or could potentially be a separate or dedicated microphone for the purpose of detecting the sound of the grooming appliance. The microphone 204 may be integrated into the housing of the user terminal 200, or may be external. Similarly the camera 208, if present, may be the same camera as used for one or more other purposes such as making video calls, capturing photos, and/or capturing video clips, or potentially could be a separate or dedicated camera for use by the grooming companion application. The camera 208 may be incorporated into the housing of the user terminal 200, or may be external (e.g. an external "webcam" type device).

The signal processing module 206 may take the form of software stored on an internal and/or external memory (comprising one or more memory devices) of the user terminal 200 and arranged to run on an internal processor (comprising one or more processing units) of the user terminal 200. Alternatively the signal processing module 206 may be implemented in the form of dedicated hardware circuitry, or configurable or reconfigurable hardware circuitry such as a Programmable Gate Array (PGA) or Field Programmable Array (FPGA), or any combination of such hardware and software included in the grooming appliance. Note also that while the processing is described as being performed by the internal signal processing module 206 of the user terminal, it is not excluded that the signal processing module 206 could achieve this by detecting the relevant audio signals and then offloading some or all of the signal processing described below to an external entity such as an external server (comprising one or more server units at one or more geographical sites) which returns the result to the signal processor 206 on the user terminal 200. Preferably however, the signal processor 206 is capable of performing all the relevant signal processing itself onboard the user terminal 200.

By whatever means the controller 106 of the grooming appliance 100 and the signal processing module 206 of the user terminal 200 are implemented, in embodiments they may be configured to operate in accordance with any one or more of the exemplary techniques disclosed below.

As mentioned, the idea is to modulate the drive signal supplied to the motor 104 in order to modulate the sound caused by the motor 104 when operating the grooming mechanism 102 (wherein this sound may comprise the sound produced directly by the motor 104 itself, and/or the sound produced by the grooming mechanism 102 when being operated by the motor 104, e.g. the buzzing of the clipper or shaving mechanism). The modulation of the sound enables a data signal to be embedded in the sound, thereby conveying information. This modulated sound can then be received using the microphone 204 of the user terminal 200, and the received sound can be processed by the signal processing module 206 in order to extract the data (i.e. to extract the information conveyed by the embedded signal).

In a first embodiment, the modulation may be achieved by switching the motor 104 on and off in a predetermined pattern in order to convey meaning. To do this, the controller 106 encodes the data to be transmitted into a pattern of pulses and modulates this pattern into the drive signal being supplied to the motor 104, by switching the drive signal between the on and off states accordingly. This thus controls the motor 104 to switch on and off according to the modulated pattern. In operation of the grooming device 100, the motor 104 will preferably be predominantly on, so in embodiments the data is therefore encoded by including an occasional off pulse amongst predominant stretches of the on state. The data may be encoded according to any suitable two-level pulse-based encoding scheme, e.g. pulse position modulation, pulse duration modulation, or pulse frequency modulation. Or even, although it may affect the grooming efficacy, it is not essential that the motor is predominantly on. E.g. a two-level (and preferably DC free) line code such as Manchester coding could be used (which on average has an even durations of off and on).

Figure 5:
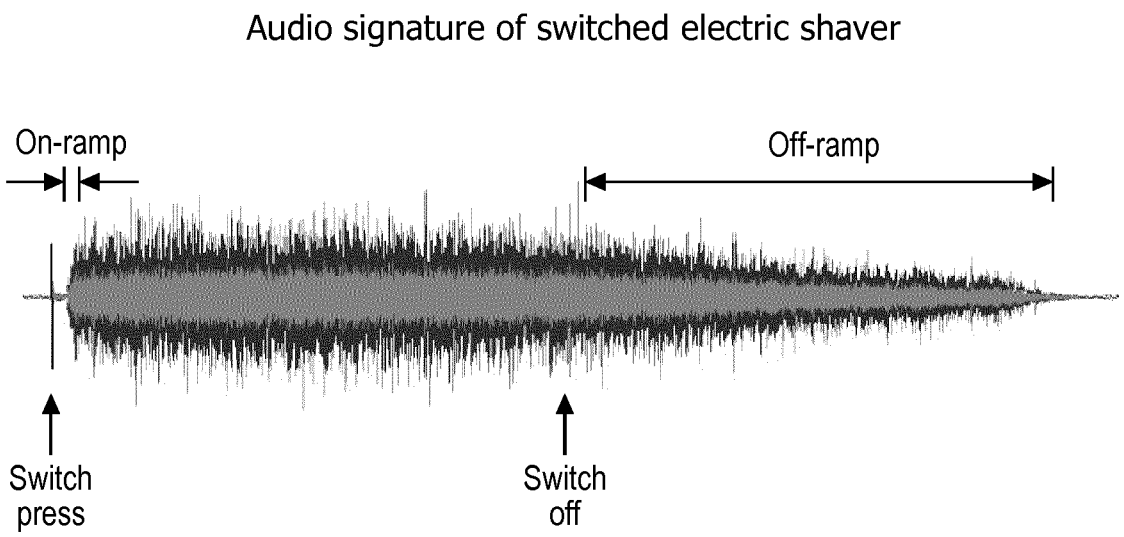
FIG. 5 is a graph showing an audio signature of a shaver in the time domain.

One factor to consider is that in practice an electric motor 104 with a connected drivetrain will often have significant inertia. When switching or modulating, the response to a step-up in rotational speed is an order of magnitude faster than the response to a step-down. This is most marked in a rotary electric shaver, though less so in a high-torque device such as a clipper. FIG. 5 illustrates the audio signature of an example shaver in the time domain, with an on-ramp duration of 50 ms whilst the off-ramp is over 1000 ms. Thus the limitation on transmission speed is the spinning-down or off-ramp of the device 100. To be detectable, a significant ramp-down time is needed between an 'off' and an 'on' again moment in order to create a sufficient delta in sound. Hence in embodiments, the minimum width of the off-pulse is a period over which the audio signature diminishes detectably, e.g. at least 300 ms or at least 500 ms, or even the full ramp-down time of 1000 ms. However, the pulse width could be significantly shorter in grooming devices 100 where the motor 104 and/or grooming mechanism 102 have a lower inertia.

As can be appreciated from the above, the on-off modulation of the cutter can result in a significant duration in which rotating at reduced cutter speed. Although this may be acceptable for some applications, there is potential for this to have an undesirable impact on the performance of the grooming appliance 100, at least in some cases, e.g. in the case that the signal is given by a shaver during shaving (such as described in relation to FIG. 5). And/or, the modulation may be noticeable to the ear of the human user, and thus may be less desirable for this reason.

Hence in more preferred embodiments, the controller 106 of the electric shaver or other such grooming device 100 is equipped with a motor control circuit that not only drives the motor 104, but also enables a forced deceleration of the motor—either to brake the motor (forcibly decelerating towards zero rotation) and/or to reverse the direction of the motor (forcibly decelerating the rotation towards zero and then the opposite direction, though in practice for the purposes disclosed herein one need not decelerate the motor as far as to actually reverse direction—see below). I.e. as opposed to simply letting the motor decelerate freely from its normal on state, the circuit enables the controller 106 to forcibly decrease or even reverse the rotation of the motor 104. In one implementation, this circuit comprises an H-bridge 400 that allows the voltage of the power source (e.g. battery) to be applied to the motor 104 in both directions.

FIG. 4 gives a schematic circuit diagram of an H-bridge for use in the controller 106 for such a purpose. The grooming device 100 comprises a power source 405 which provides a supply voltage Vin. In the case of an H-bridge (and in a number of other implementations), this will be a DC power source, typically a battery (though an external power is not excluded, e.g. an external mains supply plus an AC-DC converter onboard the grooming appliance). The H-bridge 400 in the controller 106 comprises a first switch 401, second switch 402, third switch 403 and fourth switch 404 connected as shown in FIG. 4.

As shown in FIG. 4, each switch 401-404 comprises a respective pair of first and second terminals which are connected when the switch is on and disconnected when the switch is off. The power supply 405 comprises first and second supply terminals, with the supply voltage Vin being generated across the first and second supply terminals. The motor 104 comprises first and second input terminals, wherein when a voltage is applied in one direction between the first and second input terminals then the motor rotates in one direction, and when a voltage is applied in the opposite direction between the first and second terminals then the motor 104 decelerates or rotates in the opposite direction. The first terminal of the first switch 401 is connected to the first supply terminal of the power supply 405, and the second terminal of the first switch 401 is connected to the first input terminal of the motor 104. The first terminal of the second switch 402 is connected to the first input terminal of the motor 104, and the second terminal of the second switch 402 is connected to the second supply terminal of the power supply 405. The first terminal of the third switch 403 is connected to the first supply terminal of the power supply 405 and the first terminal of the first switch 401, and the second terminal of the third switch 403 is connected to the second input terminal of the motor 104. The first terminal of the fourth switch 404 is connected to the second input terminal of the motor 104, and the second terminal of the fourth switch 404 is connected to the second supply terminal of the power supply 405 and the second terminal of the second switch 402.

The switches 401-404 are controlled by the control logic of the controller 106, so as to generate the drive signal supplied to the motor in the form of a positive or negative voltage applied across the first and second input terminals of the motor 104. The drive signal is modulated by switching between the different states according to a predetermined pattern in order to convey meaning. The states achievable with an H-bridge 400 are shown in the following table.

| $1^{st}$ switch (401) | $2^{nd}$ switch (402) | $3^{rd}$ switch (403) | $4^{th}$ switch (404) | Result |
|---|---|---|---|---|
| Closed | Open | Open | Closed | Motor on |
| Open | Closed | Closed | Open | Motor reversed |
| Open | Closed | Open | Closed | Braking |

Thus using an H-bridge 400 or other such circuit capable of forcibly decelerating the motor 104, the data can be modulated into the sound of the grooming device 100 by means of pulses between the normal on state of the motor and the reverse state of the motor. Or as an alternative, short pulses of braking the motor 104 may be included between predominant stretches of the on state. If the reverse state is use, note that in practice the motor is not necessarily decelerated as far as to actually physically reverse the direction of rotation. Nonetheless, use of the reverse state may be preferred over the braking state, because driving a reverse voltage however greatly speeds up the deceleration and therefore improves the sharpness and briefness of the signal pulse. It is faster and better detectable than braking only.

Again, any suitable two-level pulse-based code can be used, such as pulse position modulation, pulse width modulation, pulse frequency modulation, or even a (preferably DC free) line code such as Manchester coding, or a pattern such as described in U.S. Pat. No. US1647.

Thus during the running of the motor, brief signal-pulses are generated. These pulses are a brief time period where the voltage is applied in reverse to the motor. This results in a rapid deceleration of the motor, followed by a rapid acceleration at the end of the pulse. This change in rotational speed, abetted by the reverse of the accumulated play and flexing of the drivetrain, results in a clear and detectable audio signature. In general the pulses are designed to be short, relative to the reaction time of the whole motor and drivetrain. The signal-pulse decelerates the motor, but does not stop or reverse the actual direction of the motor and drivetrain. This enables much shorter pulses to be detectable than in the embodiments where the motor 104 is just allowed to freely decelerate in the off state. E.g. in the case of a shaver, a detectable pulse can be achieved that is 10 ms in duration, or even less.

Figure 6:
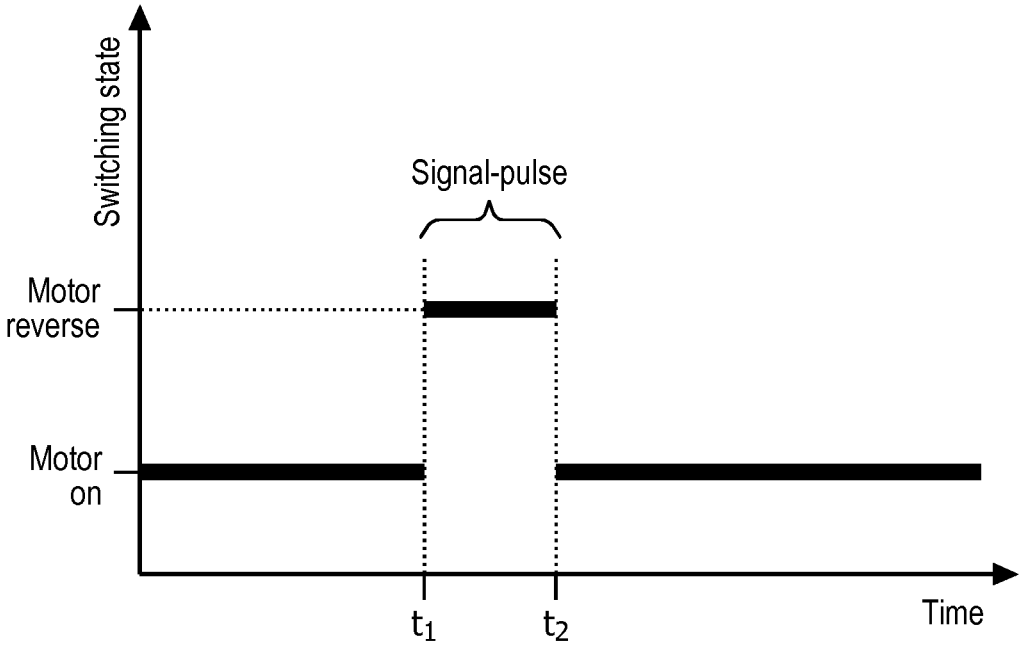
FIG. 6 is a sketch of a motor drive signal.

By way of example, FIG. 6 shows a pulse transitioning from the normal (forward) on state of the drive signal to the reverse state then back to the forward state, the switching state of the drive signal being in the reverse state for a pulse period of e.g. 10 ms before returning to the forward state. The pulse is surrounded by a longer period of the forward state either side (immediately before and after) the reverse pulse, e.g. at least 100 ms either side. Note that in the reverse state, the actual motor 104 decelerates from its normal forward rotational speed, and may or may not reach the state of physically reversing before the drive signal switches back to the forward state. Either way, even if the motor 104 does not physically reverse during the reverse state, or is only braked using the brake state, the effect is still detectable in the audio signature of the appliance 100.

By modulating a pattern over time in the signal pulses generated, information is encoded in the sound of the shaver. The time-base of the coding pattern (i.e. the symbol period) is preferably larger than the time-base (duration) of the pulses themselves. E.g. with a pulse duration of 10 ms, subsequent pulses are preferably spaced at least 100 ms apart for robust detection (or more generally the maximum pulse width is preferably no more than 10% of the symbol period). In embodiments the spacing may be even longer, to allow the total drivetrain to recover to the nominal speed.

Thus by variations of the pulses appearing over time, the information is encoded, e.g. using an on-off keying communication scheme (such as using a pattern analogous to Manchester encoding, pulse position modulation, pulse width modulation, pulse frequency modulation, etc.).

This audio signature can be detected from a recording made by a consumer grade microphone 204, such as is found in user terminals 200 like tablets, smartphones and laptops. This audio signature does not necessarily impair the correct functioning of the shaver or other such grooming device 200 significantly, and nor need it be a grossly disturbing sound so as to dominate over the regular sound of the appliance 100.

The signal processing module 206 on the user terminal 200 is configured to detect the data embedded in the audio signature of the grooming appliance 100, for instance based on any of the exemplary techniques discussed below.

In one embodiment, the pulses may be detected by noting the rapid change in instantaneous sound volume, i.e. by analysing the amplitude of the received audio waveform in the time domain (the term waveform referring to the signal amplitude as a function of time in the time domain only, without performing a transform to the frequency domain). Each pulse in the motor state will cause a pulse in the audio signal, which can be detected by the signal processing module 206 in the user terminal 200.

Figure 7:
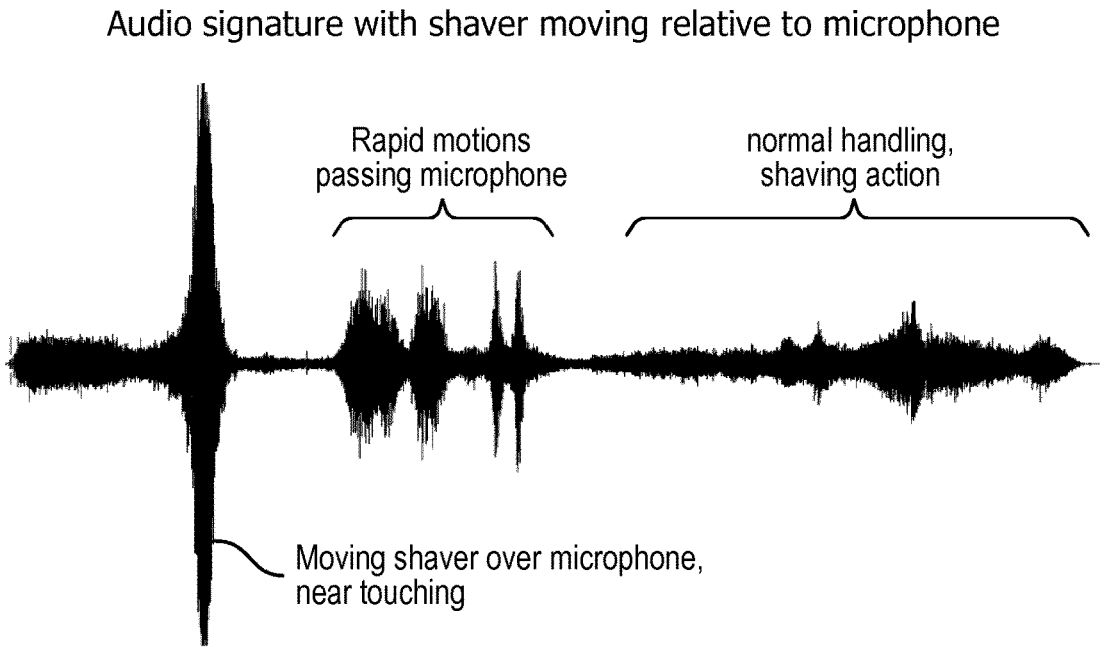
FIG. 7 is a graph showing another audio signature of a shaver in the time domain.

However, while possible, this technique may be less preferred. As illustrated by the example (amplitude) waveform shown FIG. 7, the sound volume will also change due to use handling of the appliance 100 relative to the recording microphone 204.

A more robust and practical detection method is to use the change in frequency composition of the sound, i.e. by processing the time-varying spectrum of the received audio signal in the frequency domain. Caused by the rapid pulse in the drivetrain, there is a brief change in the spectrum of the sound signal at the time of the pulse. This sudden frequency change is robust against variations in volume due to user handling. These frequency pulses can be then detected by the signal processing module 206 in the user terminal 200. For example this can be done in software by running a real-time fast Fourier transformation on the audio signal and detecting the relative 'high' and 'low' states of the selected frequency bands.

Figure 8:
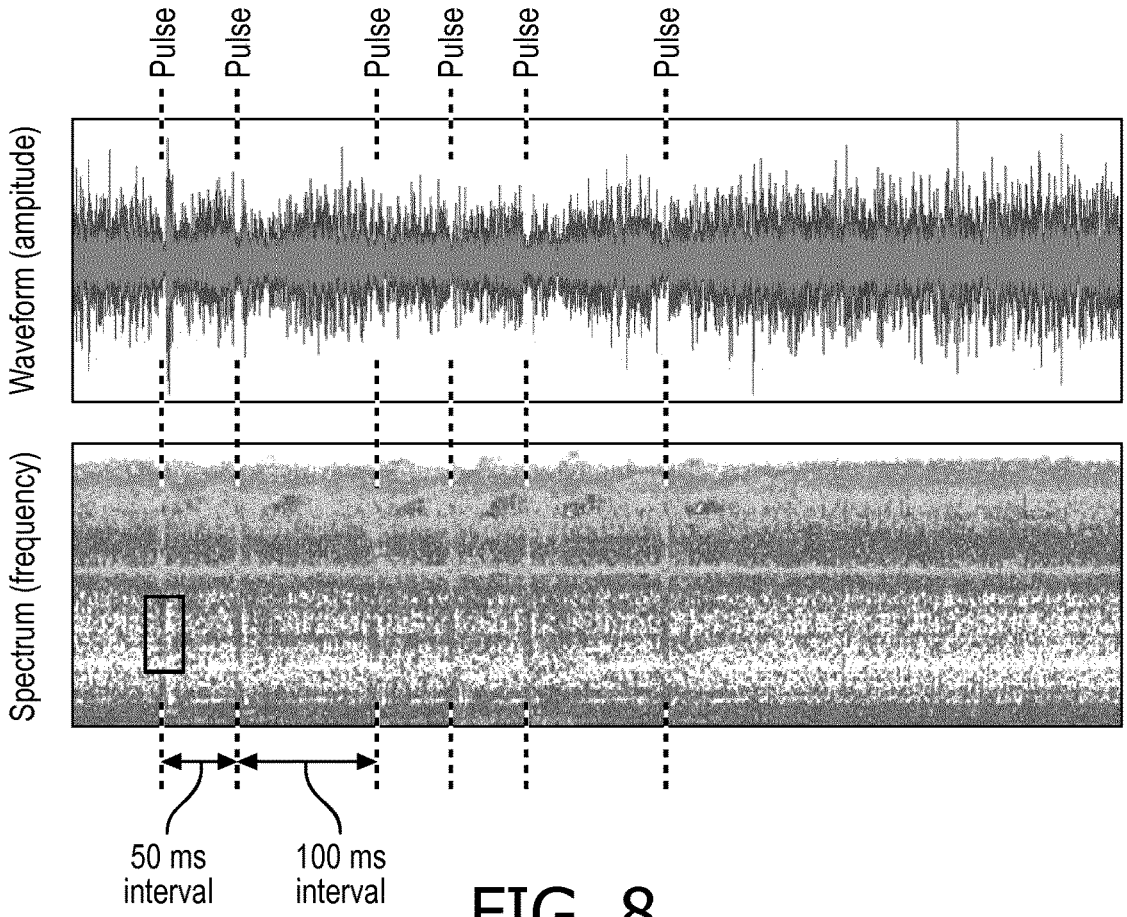
FIG. 8 is a graph showing a signal modulated into a shaver's sound in the time and frequency domains.

An example is illustrated in FIG. 8. By sequentially or continually sampling the audio signal and comparing the spectral state of the sample to defined, known characteristics of the signal pulse, it can be determined when the sample is at a time of a signal pulse. This can be done by detecting defined changes from a sampled spectral state to a subsequently sampled spectral state, or by detecting absolute properties of a sampled spectral state.

The spectral effect of a signal pulse in an example appliance 100 is a relative increase in high frequencies coupled with a decrease in lower frequencies. This is the effect of the short, sharp reversal of play in the drivetrain and associated high frequencies of impact. To define a threshold detection method for these states, a band of lower reference and of higher reference frequencies may be defined. The ratio between the averaged magnitudes (or other such representative measure) of the signal in these bands is indicative of either regular operation or a signal pulse.

Figure 9:
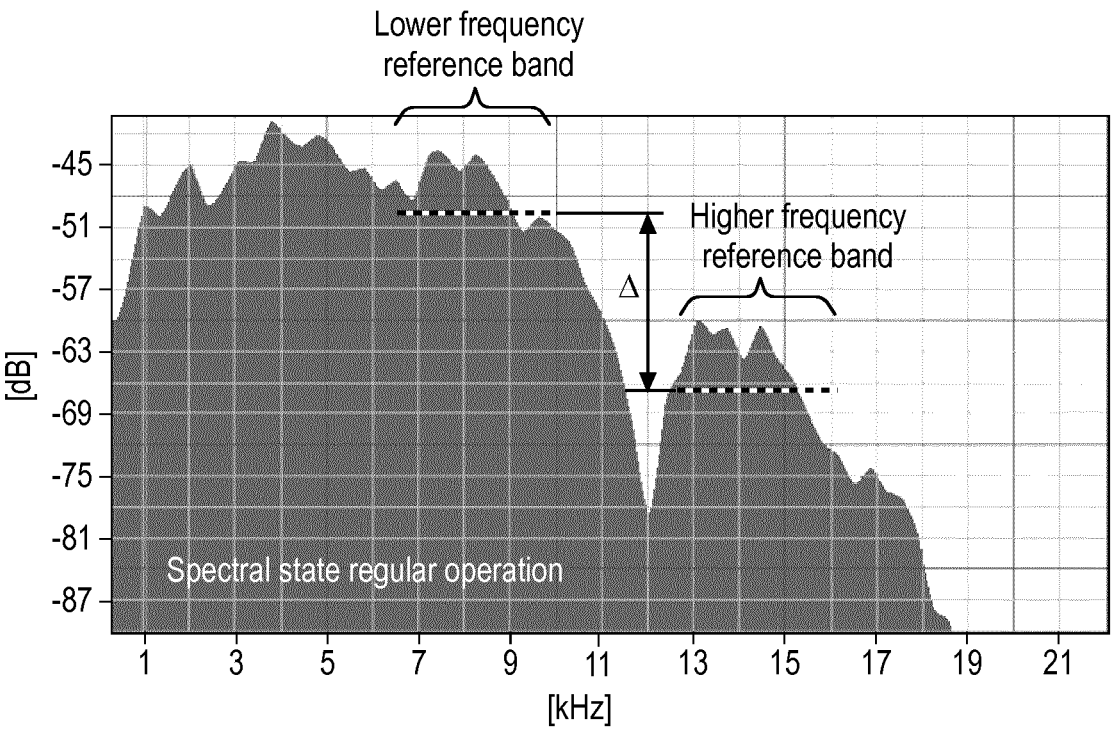
FIG. 9 is a graph a spectrum of the sound from a shaver in normal operation.
Figure 10:
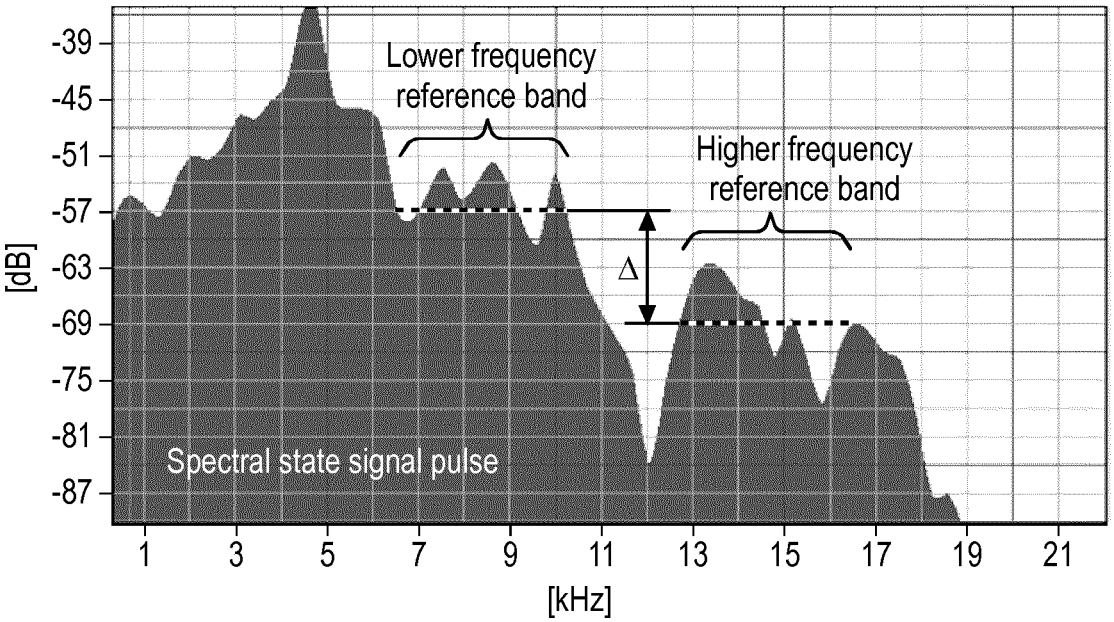
FIG. 10 is a graph a spectrum of the sound from a shaver when modulated with a signal.
Figure 11:
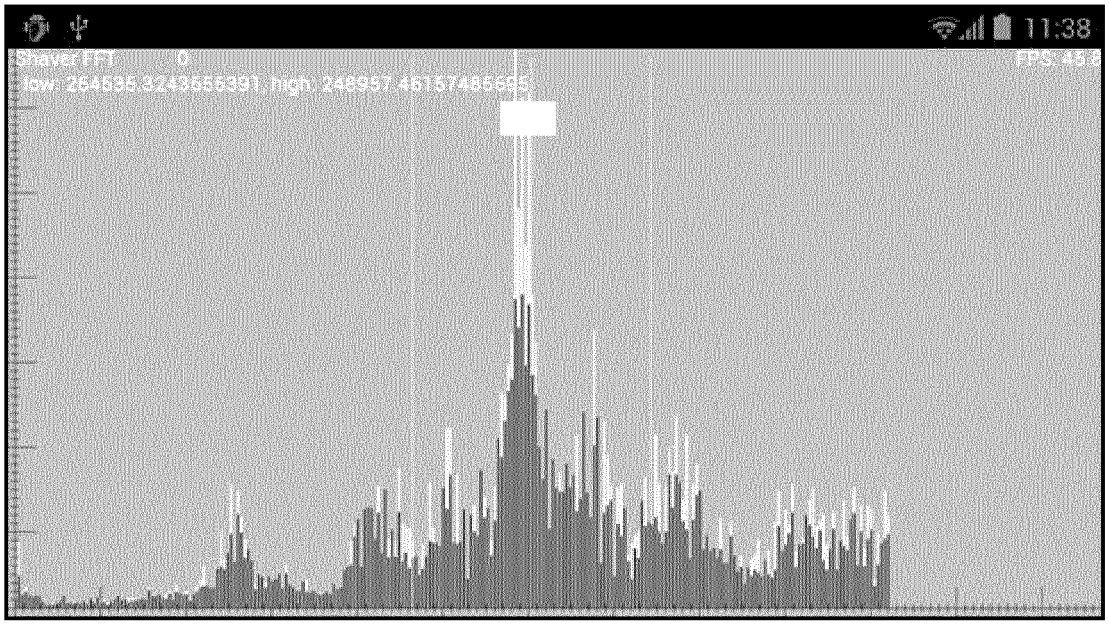
FIG. 11 is a graph showing a spectrum of the sound from a shaver.
Figure 12:
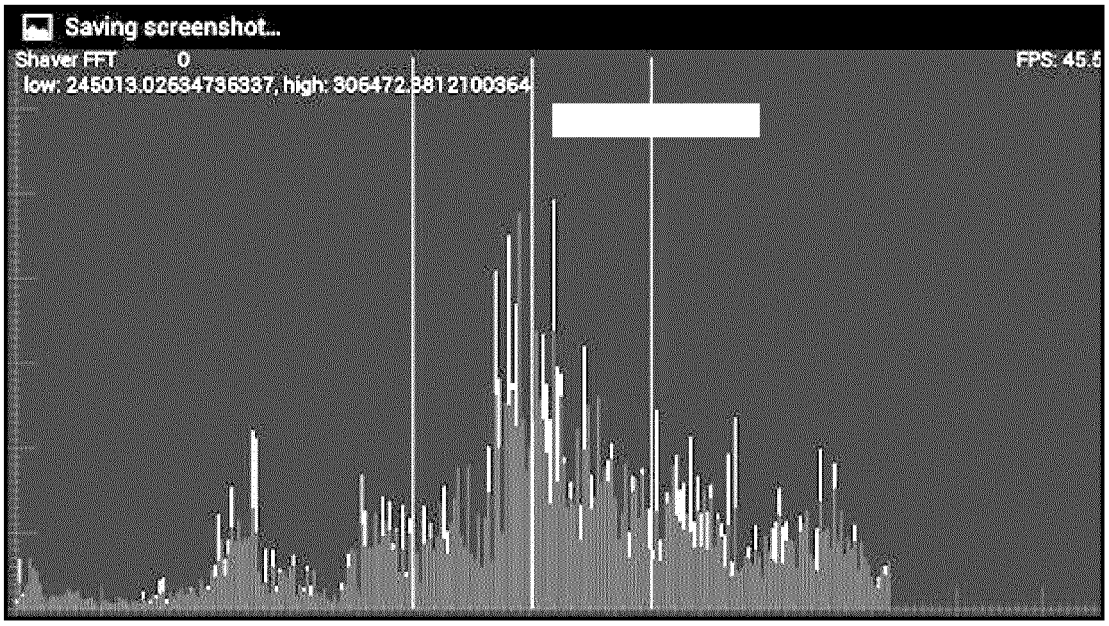
FIG. 12 is a yet another graph showing a spectrum of the sound from a shaver.

An example is illustrated in FIGS. 9 and 10. FIG. 9 shows the spectrum of the audio signal received by the microphone 204 when the motor 104 is in the normal state of operation (no pulse), while FIG. 10 shows the spectrum of the audio signal received by the microphone 204 when the motor 204 is being driven by the drive signal in the reverse state (a pulse). As can be seen, in the case of a pulse, the difference (delta) between an average or representative power level of the lower frequency band is smaller, compared to a larger difference (delta) between the average or representative power level of these bands when there is no pulse.

The detection may be based on the ratio between the averaged levels of these reference bands, or alternatively the observed delta between the two reference levels, relative to the overall spectral magnitude or peak magnitude of the sample. To be more detailed and robust in detection and offer an ability to detect more spectral states, more reference bands can be defined.

Note that whatever combination of modulation and detection techniques is used, there may sometimes still be imperfect detections. As the information being transmitted is not necessarily critical, in some applications these may simply be tolerated. However, to improve robustness further, in embodiments the pattern emitted by the grooming device 100 may use an error detection and/or correction pattern over the basic carrier method. I.e. on top of the bit-level encoding, the controller 106 will employ on a higher protocol level a method such as basic parity check or e.g. a Reed-Solomon error detection and correction method.

Using the sound caused by the motor 104 to send a message to a smartphone or tablet, or the like, can be used in several ways. For instance, this can be used to send identifying information and/or status information of the grooming appliance 100. Such information could be sent repeatedly (e.g. continually, periodically or randomly) throughout the grooming session; or only once; or in response to one or more events (e.g. a request from the user via a button or other user input means of the grooming appliance, or a request sent on an RF, infrared or coded light back channel from the user terminal 200).

As an example of sending status information, a practical usage of such sound signaling is to communicate diagnostics from the grooming device 100 to the user terminal 200. E.g. in the cases where there is an alert or a problem to be communicated to a user, such as the battery level or consumable falling below a threshold, or an operating temperature exceeding a safe threshold, or the appliance 100 is locked from use, then the acoustic link can provide richer information to a user. Conventionally an LED will indicate a state by being lit or blinking, and a symbol near the LED may indicate the nature of the information (e.g. needs cleaning, am travel-locked or empty battery). By using an acoustic link, more detailed information can be communicated (e.g. display that the appliance is travel locked and also provide instructions in the smartphone application how to unlock). Please note in the example of signaling the appliance is locked, this would require a brief, temporary "on" period on order to signal this fact. E.g. the appliance 100 may be travel locked to prevent accidental battery drainage, such that if the "on" button is pressed, the appliance turns on temporarily, just long enough to emit a brief signal, then turns off again automatically. Thus if the appliance's "on" switch accidentally gets pressed in the user's bag or such like, the battery usage is minimal; but on the other hand if the user is trying to use the appliance 100 deliberately and has just forgotten the travel lock is on, the signal from the grooming appliance 100 can inform the user via the companion app that this is what the problem is. A brief on period is acceptable for the travel lock function to remain meaningful: the reason and function of the travel lock is not to never have a motor on event, but rather to prevent the accidental switching on and then draining the battery to empty whilst unattended in the luggage.

Another practical usage is for the sound signalling to take place at every appliance 'on' event. Every time the user activates the appliance 100 (e.g. by pressing the on button), the appliance transmits a type and/or model signature (and optionally this could be repeated one or more times throughout the operation of the appliance 100 to increase chance of detection). The appliance will wait for the motor to achieve normal operation (e.g. 200 ms to rev up sufficient) and then the signal-pulses are transmitted through the motor sound. The content of the message may comprise an appliance type identifier (shaver, clipper, epilator, etc.) and/or a model identifier (e.g. Philips RQ1150). When a user is running the companion application running on the user terminal 200 (e.g. a smartphone), the application is listening through the microphone 208 for sound. When the characteristic signature of the signal-pulses is observed (e.g. the rapid shifts in frequency spectrum at regular periodic intervals), the information is decoded. This allows then the application to determine the type and/or model of appliance currently in use and modify the interface presented to the user to match the type of appliance and its capabilities. Also any links to relevant documentation such as user manuals or related products (e.g. consumables) may be made to match the detected appliance type and/or model.

Note: the information transmitted embedded in the sound from the grooming appliance 100 may comprise the desired content included explicitly (directly) in the audio signal, or alternatively may comprise a code or identifier which maps to the desired content. In the latter case, the signal processing module 206 on the receiving user terminal looks up the code or identifier in a look-up table mapping possible values of the code or identifier to respective items of content. The look-up table could be stored locally on a memory of the user terminal 200, or could be a database hosted on a server (comprising one or more server units at one or more sites) in which case the user terminal 200 is configured to access the server in order to perform the look-up. For instance, the transmitted information may comprise a fault code or other status code, which is mapped by the look-up table to a respective meaning of that code (battery low, etc.). Alternately or additionally, the transmitted information may comprise a code corresponding to the type of appliance 100 (the type being shaver, clipper, epilator, etc.), and/or a model number of the appliance; and the look-up may map the identifier(s) to type- and/or model specific content, such as instructions for use, an instruction manual, and/or modifications to the user interface of the companion application to match the type and/or model of the appliance 100. As another alternative or additional example, the transmitted information may comprise a unique ID of the individual appliance 100 and/or its user (e.g. serial number, MAC address and/or user ID), and the look-up may map this ID to personalized settings for the appliance (e.g. how the user likes the user interface of his or her companion application to appear).

Whatever the content is, and whether received explicitly or looked up based on a received code or ID, this may be output to the user in any suitable form. For instance, in one particularly advantageous application, the companion application running on the user terminal could be a "smart mirror" application which uses a camera 208 (e.g. front-facing camera) of the user terminal 200 to capture a live image of the user who is currently grooming him- or herself with the grooming appliance 100. In this case, the application may augment the image of the user with one or more items of content derived from the audio signal (by overlaying the content over the image or displaying it in vicinity of the image).

Optionally, the user may also be able to interact with the content via the user interface 202—e.g. pressing an icon on screen to summon the content or summon more detailed content, or selecting which items of content to include in the user interface (e.g. which to show in the smart mirror), and perhaps saving personalized settings for this. And/or, if the content informs the user, based on the received audio signal, that a consumable of the grooming appliance is low or has run out, or a part needs replacing or is close to needing replacement, or the appliance 100 is in need of repair, servicing, cleaning or close to needing this; then the user interface of the application may present the user with an Internet link by which he or she can order the relevant consumable, part, repair, cleaning product or service.

Yet another practical usage for the sound signalling is to enable a hassle-free authentication for another communication mode. For example, it may be desired to establish an RF channel such as a Wi-Fi, ZigBee or Bluetooth link between the grooming appliance 100 and the user terminal 200, but the user terminal 200 may require the grooming device to be authenticated to establish the channel. In this case the establishment of the channel (e.g. pairing) may be streamlined by communicating the required authentication code or codes (e.g. pairing codes) to the user terminal 200 via the acoustic channel. Thus a hassle-free authentication can be implemented on top of a permissive communication channel such as Bluetooth LE.

It will be appreciated that the above embodiments have been described only by way of example.

In embodiments that do modulate the sound caused by the motor 104, note that an H-bridge is not the only type of circuit possible for controlling a motor. Other circuits for controlling a motor to stop, start, reverse and/or brake may (in themselves) be known to a person skilled in the art. Also, other methods of modulating the behaviour of the motor and therefore the sound may be implemented. For example, it would also be possible to modulate the speed of motor, e.g. to modulate between three or more discrete speed states (according to a ternary or greater code), or continuously vary the speed (according to a continuously variable modulation scheme). As these variations will also cause corresponding changes in the sound of the motor 104 and/or associated mechanism 102, these present alternative ways that data can be modulated into the sound for detection by a signal processing nodule 206 on a receiving user terminal 200.

Further, the techniques disclosed herein holds for any type of motor. For example, the disclosed techniques work not just for a conventional brush-based motor, but also for a (more costly) electronically commutated motor (ECM) (brushless motor). In this case the modulating of the motor may be similarly performed via the electronics and programmed logic that drive the motor. Moreover, whilst the vast majority of appliances use rotary electric motors, there exists appliances that use a linear electric motor instead. These are usually of the reciprocating kind. The basic principle disclosed herein also will work with a linear motor instead of a rotary motor (e.g. by modulating the linear motor on and off, or modulating the speed of the linear motor).

Note also that while the sound being produced will generally comprise at least a component in the human audible range (20 Hz-20 kHz), the component of the sound being modulated need not necessarily be in the human audible range. In embodiments, the sound or the modulated component of the sound may be in the range of human hearing, or above this range (>20 kHz), or even below this range (<20 Hz), or may overlap two or all of these ranges. Note that 20 Hz-20 kHz is the maximum human audible range, mostly only audible by humans at a young age, while for most adults the high-frequency range realistically ends around 18 kHz or much less. In practice a sound at 19.5 kHz is within range of all audio circuitry of electronics and exceeds hearing range of 99% of users. Hence while human audible range may be defined herein as 20 Hz-20 kHz, if it is desired that the modulated signal component falls outside the practical human audible range, it may be considered sufficient that the signal falls for example beyond only 19.5 kHz, or only beyond 18 kHz.

Further, in the case where some or all of the signal processing module 206 is implemented in software, this signal processing may be implemented as an integral part of the companion application (e.g. smart mirror application) through which the detected content is output, running on the user terminal 200; or the signal processing module 206 could be a plug-in application to the companion application running on the same user terminal 206. In some embodiments, the companion application could even be hosted on a server, and the signal processing module may be included in a client application which provides the decoded information from the received audio signal to the application running on the server.

Furthermore, the techniques disclosed herein could be applied to other types of grooming appliance, not just shavers, clippers and epilators. Other grooming appliances may include for example a motorised brush or other bodily cleaning appliance, in which case the brush or cleaning element is mechanically coupled to the rotor of an electric motor (directly or indirectly) so as to move cyclically when the motor is energized. In such appliance, the motor and/or mechanism again produce a sound when in operation, and this sound may be modulated to transmit data.

Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. A single processor or other unit may fulfil the functions of several items recited in the claims. The mere fact that certain measures are recited in mutually different dependent claims does not indicate that a combination of these measures cannot be used to advantage. A computer program may be stored/distributed on a suitable medium, such as an optical storage medium or a solid-state medium supplied together with or as part of other hardware, but may also be distributed in other forms, such as via the Internet or other wired or wireless telecommunication systems.

Any reference signs in the claims should not be construed as limiting the scope.

The invention claimed is:

1. A grooming appliance comprising:
a grooming mechanism for grooming a user;
a motor configured to operate the grooming mechanism; and
a controller configured to modulate a data signal into sound produced by the motor during the operation of the grooming mechanism by the motor, to form a modulated sound signal including information relating to the grooming appliance;
wherein the controller is configured to supply and vary a drive signal to the motor in order to control the motor and to produce the modulated sound including the data signal modulated into the sound produced by the motor.

2. The grooming appliance of claim 1, wherein the controller is configured to vary the drive signal by switching the drive signal between an on state which controls the motor to turn on and an off state which controls the motor to turn off.

3. The grooming appliance of claim 1, wherein the controller is configured to vary the drive signal by switching the drive signal between a forward state which controls the motor to rotate in a forward direction and a reverse state which controls the motor to rotate in a reverse direction.

4. The grooming appliance of claim 1, wherein the controller is configured to vary the drive signal by switching the drive signal between an on state which controls the motor to turn on and brake state which controls the motor to brake.

5. The grooming appliance of claim 1, wherein said information comprises one or more of:
information on a status of the grooming appliance,
a unique identification of the grooming appliance,
an identification of a model and/or type of the grooming appliance,
an identifier of a user of the grooming appliance,
an indication of one or more capabilities of the grooming appliance,
an indication of one or more instructions for using the grooming appliance, and/or
authentication information for authenticating the grooming appliance to communicate via another communication channel.

6. A grooming appliance comprising:
a grooming mechanism for grooming a user;
a motor arranged to operate the grooming mechanism; and
a controller configured to modulate a data signal into sound produced by the grooming appliance during the operation of the grooming mechanism by the motor, in order to transmit information relating to the grooming appliance;
the controller is arranged to supply a drive signal to the motor in order to control the motor to perform said operation of the grooming mechanism,
said sound is caused by the motor when performing said operation of the grooming mechanism, and
the controller is configured to perform said modulation by varying the drive signal in order to modulate said data signal into the sound caused by the motor during said operation of the grooming mechanism.

7. The grooming appliance of claim 6, wherein the controller is configured to perform said variation of the drive signal by switching the drive signal between an on state which controls the motor to turn on and an off state which controls the motor to turn off.

8. The grooming appliance of claim 6, wherein the controller is configured to perform said variation of the drive signal by switching the drive signal between a forward state which controls the motor to rotate in a forward direction and a reverse state which controls the motor to rotate in a reverse direction.

9. The grooming appliance of claim 8, wherein the controller comprises an H-bridge circuit arranged to generate the drive signal with said forward and reverse states, or said on and brake states.

10. The grooming appliance of claim 6, wherein the controller is configured to perform said variation of the drive signal by switching the drive signal between an on state which controls the motor to turn on and brake state which controls the motor to brake.

11. The grooming appliance of claim 6, wherein the grooming appliance comprises a buzzer or speaker and said sound is emitted by the buzzer or speaker, the sound comprising at least a component in the human audible range, and the buzzer or speaker being separate from said motor and grooming mechanism, but arranged to emit said sound during the operation of the grooming mechanism by the motor.

12. The grooming appliance of claim 6, wherein said information comprises one or more of:
information on a status of the grooming appliance,
a unique identification of the grooming appliance,
an identification of a model and/or type of the grooming appliance,
an identifier of a user of the grooming appliance,
an indication of one or more capabilities of the grooming appliance,
an indication of one or more instructions for using the grooming appliance, and/or
authentication information for authenticating the grooming appliance to communicate via another communication channel.

13. The grooming appliance of claim 12, wherein said information comprises at least the information on the status of the grooming appliance, and wherein said information on the status of the grooming appliance comprises one or more of:
a battery level of a battery powering said motor;
an indication of a fault with the grooming device;
an indication that a consumable of the grooming appliance is in need of replacement or approaching the need for replacement;
an indication that the grooming mechanism is in need of cleaning, service or repair or approaching the need for cleaning, service or repair; and/or
an indication that the grooming appliance is locked such that said grooming mechanism cannot be operated.

14. The grooming apparatus of claim 6, wherein the grooming appliance is a shaver, hair-clipper or epilator; the grooming mechanism being a shaving mechanism, hair-clipping mechanism or epilating mechanism respectively.

* * * * *